US005487656A

United States Patent [19]

Kaitanjian

[11] Patent Number: 5,487,656

[45] Date of Patent: Jan. 30, 1996

[54] DECORATIVE FORMING APPARATUS

[76] Inventor: Michael A. Kaitanjian, 16067 Arbela Dr., Whittier, Calif. 90603

[21] Appl. No.: 242,273

[22] Filed: May 16, 1994

[51] Int. Cl.[6] ..... B29C 59/02; E01C 23/02

[52] U.S. Cl. ..... 425/385; 404/89; 425/458

[58] Field of Search ..... 425/458, 385; 404/89, 93; D8/45

[56] References Cited

U.S. PATENT DOCUMENTS

| | | | |
|---|---|---|---|
| D. 282,623 | 2/1986 | Nasvik | D8/45 |
| 4,131,406 | 12/1978 | Fresquez | 425/385 |
| 4,135,840 | 1/1979 | Puccini et al. | 404/89 |
| 4,231,677 | 11/1980 | Roming | 404/89 |
| 4,776,723 | 10/1988 | Brimo | 425/458 |
| 5,061,172 | 10/1991 | Fennessy, Sr. | 425/385 |

FOREIGN PATENT DOCUMENTS

| | | | |
|---|---|---|---|
| 588021 | 4/1925 | France | 425/385 |
| 2208883 | 4/1989 | United Kingdom | 404/93 |
| 2214211 | 8/1989 | United Kingdom | 404/93 |

*Primary Examiner*—Robert B. Davis
*Attorney, Agent, or Firm*—Edgar W. Averill, Jr.

[57] ABSTRACT

An improved forming tool for imprinting a textured pattern in concrete, the tool having the property of appearing identical to a fixed observer after rotation about a center point in four orientations. The tool can be fitted with adjacent tools in any one of the four orientations. The tool includes a backing plate having handles for imprinting a pattern and lifting the tool from the concrete. The underside of the tool includes a plurality of rectilinear grout lines separating areas of texture, the grout lines forming grooves in the concrete to define simulated stones having a roughened surface left by the textured areas.

5 Claims, 4 Drawing Sheets

A
B
C
D
E

DECORATIVE FORMING APPARATUS

FIELD OF THE INVENTION

The present invention relates to implements for forming patterns in a soft material, and more particularly, to an improved texturing tool for forming decorative patterns in concrete.

BACKGROUND OF THE INVENTION

Tools for forming decorative patterns in concrete to provide the appearance of brick, cobblestone, slate, stone, tile and wood have gained in popularity in recent years. There are a number of advantages to using such tools in concrete as opposed to the authentic hand-laid materials. First, the cost of materials and labor to imprint the pattern in a bed of concrete is greatly reduced from that of laying real stone or brick. In addition, the concrete provides an extremely durable and lasting surface when cured. Independent hand-laid stones or bricks have gaps in between which, despite being filled with mortar, may cause them to settle to result in a uneven surface. Finally, a solid layer of concrete prevents the disruptive, unsightly upgrowth of weeds or other vegetation which inevitably occurs with separate stones or bricks.

There are two general classes of tools for forming decorative patterns in concrete. A first type simply forms decorative grout lines and is embodied in U.S. Pat. No. 4,135,840 issued to Puccini et al. This patent discloses a tool for printing non-repeating false stone outline patterns in concrete. The blades of the tool used to form the grout lines between the false stones all terminate at identical locations on each of the four sides around the generally square tool. Thus, the terminal ends of each blade line up with the extending terminal ends of the blades of another tool, or with the first tool rotated. However, this type of tool cannot imprint a textured surface in the concrete and depends on the absence of a peripheral border line to ensure the random appearance of a plurality of side-by-side patterns.

The second class of tools include an outer border surrounding a textured surface which is pressed into the concrete to give a three-dimensional appearance to the concrete. Typically, the region within the outer border is divided by a grout line pattern to delineate simulated stones. The tools usually include one or more handles on the rear side so that the imprint may be pressed down and the tool subsequently lifted. One example of such a tool for forming a decorative impression in concrete is shown in U.S. Pat. No. 5,061,172, issued to Fennessy, Sr. This patent discloses a generally square forming tool having a cutout in one corner so that adjacent rows of tools may be laid down on the concrete at a slight offset. Each tool must be oriented with the cutout at the same corner for the tools to fit together. This type of tool is seen in the prior art illustrations of FIGS. 1–6.

The biggest problem aesthetically with prior texturing tools has been the frequent positioning of two or more of the same tool patterns in close proximity, thus creating a repetitive appearance which, if noticed, reveals the false stones for what they are. Because tools such as those of Fennessy, Sr. cannot be rotated, each individual tool can only form one grout line pattern from the vantage point of a fixed observer. A random appearance is thus unavailable unless a large number of tools are used having different inner grout line patterns. However, the use of a large number of tools is costly and also awkward as the tools weigh quite a great deal and must be transported and laboriously installed on the concrete.

A number of concrete texturing tools have been developed by Precision Stamped Concrete Tools of Pico Rivera, Calif. Some of the tools developed generally have an outer border having a shape which can be closely fitted together with all of the surrounding shapes to together form the desired pattern. When imprinting a pattern of random stone in concrete, for example, Matcrete has designed a tool having six outwardly extending portions which are capable of mating with adjacent tools in any of six orientations. While this is a great advantage for random stone patterns, popular rectilinear simulated stones such as Ashler slam cannot be fitted within such an irregular outer border.

To date, there is a need for an improved forming tool for reproducing the look of stones such as Ashler slate which provides a more random final appearance.

SUMMARY OF THE INVENTION

The present invention provides a tool for forming imprints in concrete, comprising a rectilinear outline having a plurality of outwardly extending legs, a support frame, a lower patterned forming surface defined by rectilinear grout lines within the outline and a center point. The outline of the tool has the property that the tool can be rotated about the center point so that the outline appears identical to a fixed observer in more than one orientation. Preferably, the tool includes four outwardly extending legs which are offset from one another in a rotational direction so that one tool may be rotated and fit next to a second tool in any one of four orientations.

The tools are shaped to fit together for forming a mosaic made up of a plurality of individual tool pattern imprints. The rectilinear grout line pattern forms grooves in the concrete which define borders of simulated rectilinear stones, the tool additionally having textured surface between the grout lines so that the upper surface of the simulated stone has a realistic 3-dimensional roughness.

In one method of using the tool of the present invention, the tool is laid down without rotation to form a repeated mosaic in the concrete. In a variation of the first method of use, the tool is imprinted in the concrete once and then rotated 90°, 180° or 270° before pressing a second imprint adjacent the first, the process being repeated and the tool rotated 90°, 180° or 270° every time to form a mosaic.

In a preferred method of use of the present invention, a plurality of tools are used to imprint a mosaic in a bed of concrete, the tools being rotated and alternated to form a substantially random pattern.

DESCRIPTION OF THE PREFERRED EMBODIMENTS

The present invention overcomes the deficiencies of forming tools of the prior art by being capable of rotation in order to greatly increase the number of possible patterns laid down by each tool. In order to better appreciate the disadvantages of prior forming tools, FIGS. 1–6 illustrate the limited number of arrangements using these tools.

Figure 1:
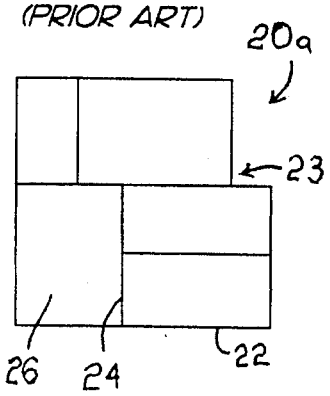
FIG. 1 (PRIOR ART)
FIGS. 1–3 are bottom plan views of tool of the prior art having three different stone patterns.
Figure 2:
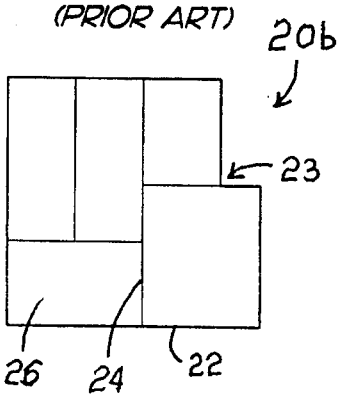
FIG. 2 (PRIOR ART)
Figure 3:
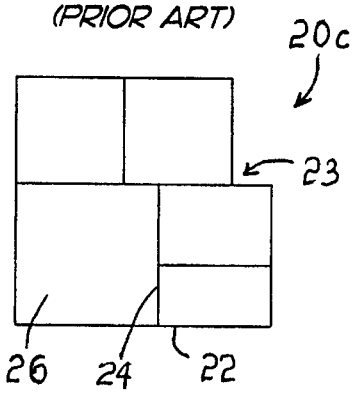
FIG. 3 (PRIOR ART)

FIGS. 1–3 show examples of prior forming tools 20*a*, 20*b* and 20*c*, respectively. Each of the tools 20 has a similar shaped outline 22 defining a square with a rectangular cutout 23 in the upper right corner. The tools 20 have a pattern of grout lines 24 separating a number of textured areas 26 for imprinting separate rectilinear simulated stones. The textured areas 26 are thus arranged within the outline 22 in different patterns to imprint various simulated stone patterns in a bed of concrete.

Figure 4:
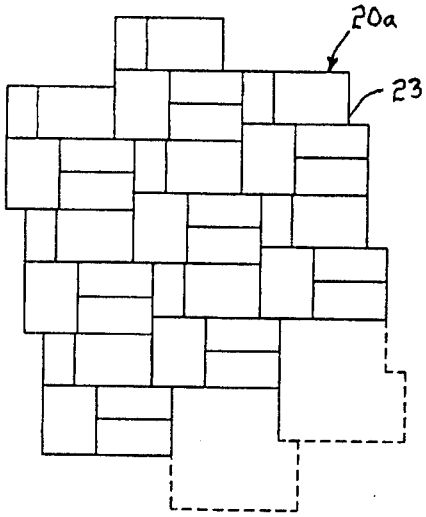
FIG. 4 (PRIOR ART)
FIG. 4 is a repeated mosaic formed with the prior art tool of FIG. 1.
Figure 5:
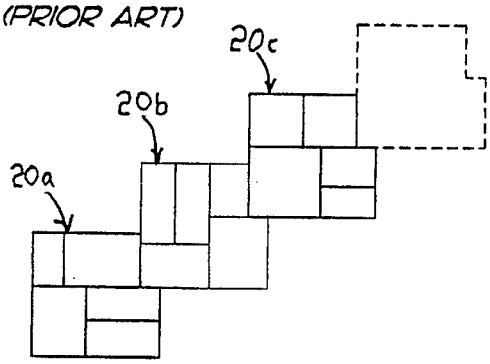
FIG. 5 (PRIOR ART)
FIGS. 5 and 6 are two possible imprint sequences of the three prior art tools of FIGS. 1–3 laid in a row.
Figure 6:
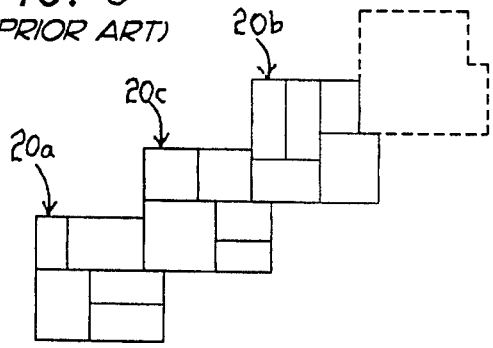
FIG. 6 (PRIOR ART)

FIG. 4 shows a repeated mosaic formed in a bed of concrete by only using the tool 20*a*. The tool 20*a* has been laid down side by side with the bottom left corner of every tool fitting in the cutout 23 of the next tool down and to the left in a row. In the views of FIGS. 5 and 6, all three tools 20*a–c* are shown in a single row in two sequences. In FIG. 5, the sequence is 20*a*–20*b*–20*c*. In FIG. 6, the sequence is 20*a*–20*c*–20*b*. These represent the only two possible non-repeating sequences for the three tools in a row (i.e. with tools abutted on each end of the subset of three). The dashed outlines represent the next tool in the rows which in both cases would be the tool 20*a*. The fact that every fourth tool imprint is repeated thus clearly illustrates the inability to simulate a random mosaic using the tools of the prior art. Furthermore, each row has a similar row on either side which positions identical tools in close proximity throughout the entire final assemblage.

Figure 7:
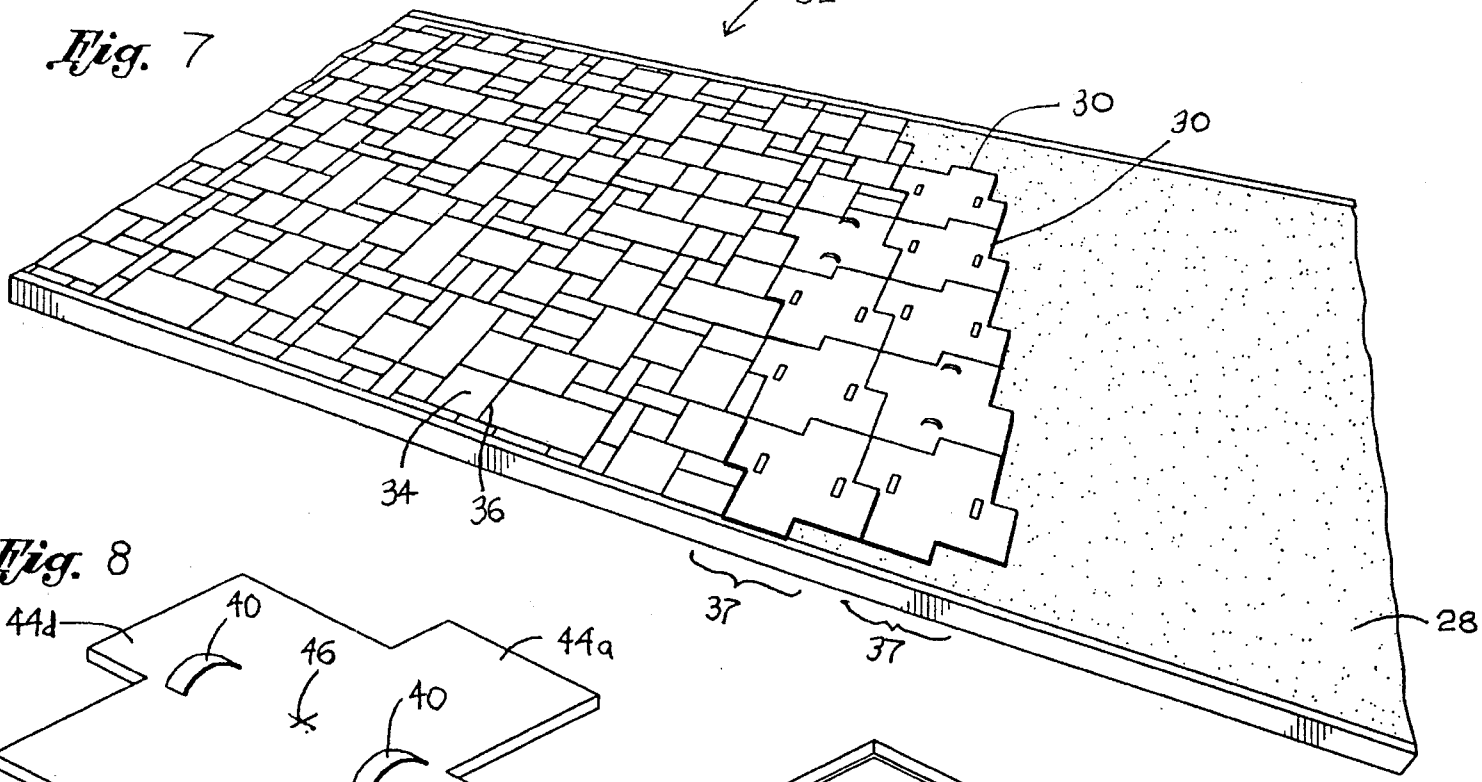
FIG. 7 shows the improved forming tool of the present invention during the process of forming a non-repetitive mosaic in a bed of concrete.

Now with reference to FIG. 7, a bed of concrete 28 is shown with a number of tools 30 of the present invention used to imprint a geometric mosaic 32 of rectangular stones 34 separated by grooves 36. As seen, the tools 30 are laid down side by side in rows 37 which are slightly offset from one another due to the unique shape of the tools. The mosaic 32 formed has a substantially random distribution of the rectangular stones 34, which may be designed to reproduce the look of Ashler slate or other types of materials cut in random rectangular sizes.

Figure 8:
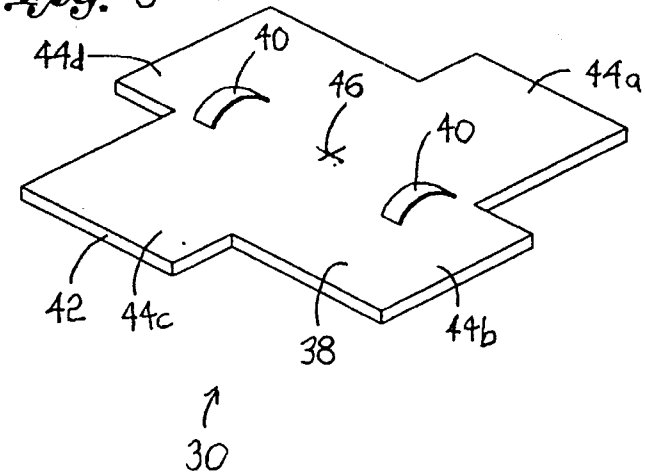
FIG. 8 is a top perspective view of the improved tool of FIG. 7.
Figure 9:
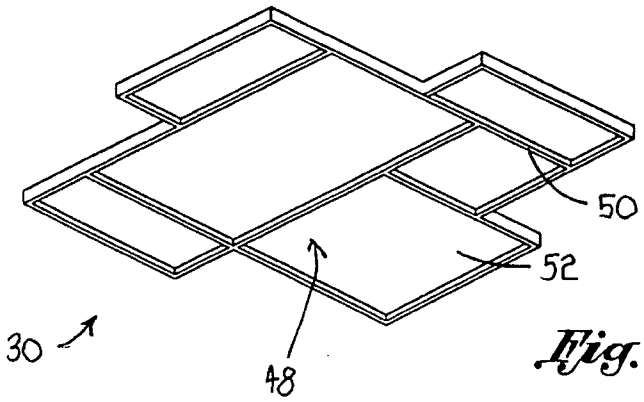
FIG. 9 is a bottom perspective view of the tool of FIG. 7.

With reference to FIGS. 8 and 9, the tools 30 of the present invention will be generally described. The tools 30 comprise a backing plate 38 having one or more lifting handles 40 attached thereto. The backing plate 38 is bordered on all sides by peripheral edges defining a rectilinear outline 42 of each tool. In general, the outline 42 of the tools 30 defines an offset cross pattern having generally opposing legs 44*a–d*. Specifically, each two opposing legs 44*a,c* and 44*b,d* are offset from a line through a center point 46, the line extending parallel to the sides of the opposing legs. The center point 46 is located equidistant from the outermost edge of each extending leg 44.

The opposing legs are offset the same distance and in the same rotational direction around the tool 30. Consequently, the preferred forming tool 30 may be rotated about the center point 46 in any one of four 90 degree orientations while maintaining an identical outline 42 as viewed from a fixed vantage point. The tools 30 will fit together to form the mosaic 32 in any of the four orientations, thus greatly facilitating the installation process.

Now looking at the bottom view of FIG. 9, the bottom of each tool 30 defines a unique pattern 48 which includes a number of grout lines 50 separating generally flat rectilinear regions 52 having surface texture. The grout lines 50 extend slightly farther below the regions 52 to imprint the channels or grooves 36 between the simulated stones 34, as seen in FIG. 7. The peripheral edge grout lines 50 form grooves in the concrete and align with the grooves formed by the peripheral edge grout lines of adjacent tools. The pattern 48 comprise a number of the varying sized regions 52 defined by the grout lines 50 which are arranged in a puzzle-like manner to fall the outline 42.

In the preferred embodiment, the tools 30 are molded from an elastomer polyurethane which has sufficient stiffness to form an imprint in partially cured concrete and can be lifted off the wet concrete in a manner which avoids pulling clumps of concrete up as well. Also, a vibratory motion may be imparted to the upper surface of the backing plate 38 to assist the non-stick removal of the tool 30. The handles 40 are preferably nylon or other strong fabric and are securely embedded in the backing plate 38 during a molding process.

Figure 10:
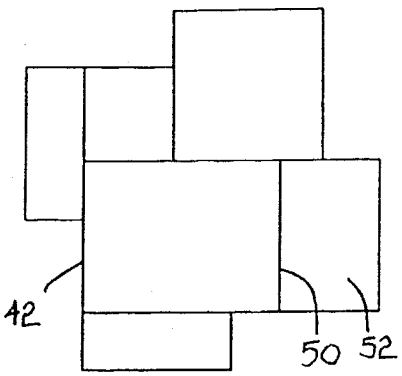
FIGS. 10, 11 and 12 are bottom plan views of the tool of FIG. 7 having three different stone patterns.
Figure 11:
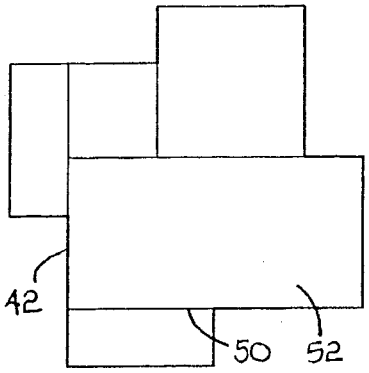
Figure 12:
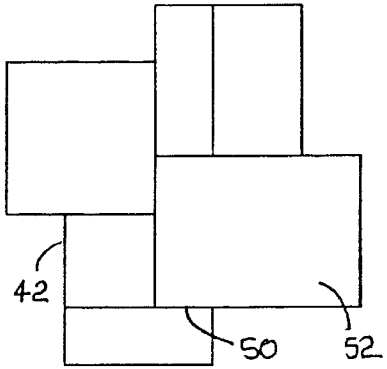

With reference to FIGS. 10, 11 and 12, any number of unique patterns 48 within the outline 42 of each tool 30 can be constructed. FIG. 10 shows a random distribution of 6 rectangular shapes within the border 42. Likewise, FIGS. 11 and 12 show random distributions of 5 and 6, respectively, rectangular shapes to define the particular pattern 48. Depending on the end result desired, the tools 30 may be laid down in a variety of ways to produce a repeated or more random mosaic.

Figure 13:
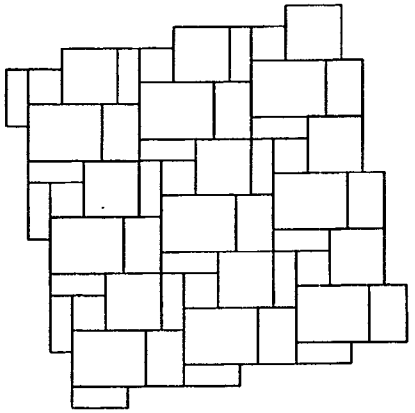
FIGS. 13, 14, and 15 are repeated mosaics formed with the tools of FIGS. 10, 11 and 12, respectively.
Figure 14:
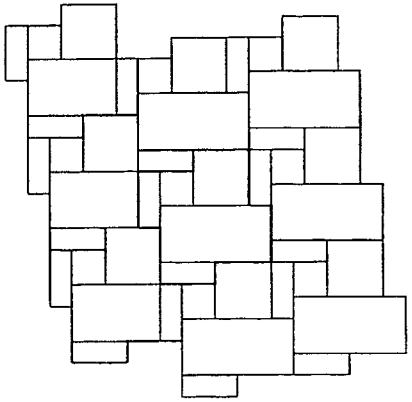
Figure 15:
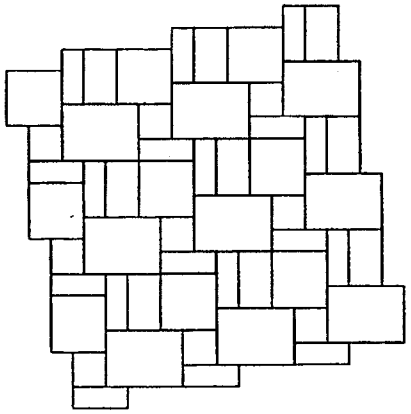

Specifically, FIGS. 13, 14 and 15 show three examples of regular repeated mosaics which were created by the tools of FIGS. 10, 11 and 12 respectively. These patterns were formed by laying tools down in rows without rotating. Such a repeated pattern is sometimes desirable to create a certain effect or make an artistic statement.

However, most customers of the Ashler slate and similar rectilinear material designs prefer to have a more random distribution of the simulated stones 34. Thus, in an alternative method of laying a single tool 30 down, FIGS. 16*a–j* show the various combinations formed by rotating the tool shown in FIG. 10. By rotating the tool 30, a total of four different patterns 48 is possible while the outline 42 remains consistent and thus the tool can be closely fitted around other tools or preformed imprints of the same tool.

Figures 16A, 16B, 16C, 16D, 16E, 16F, 16G, 16H, 16I, 16J:
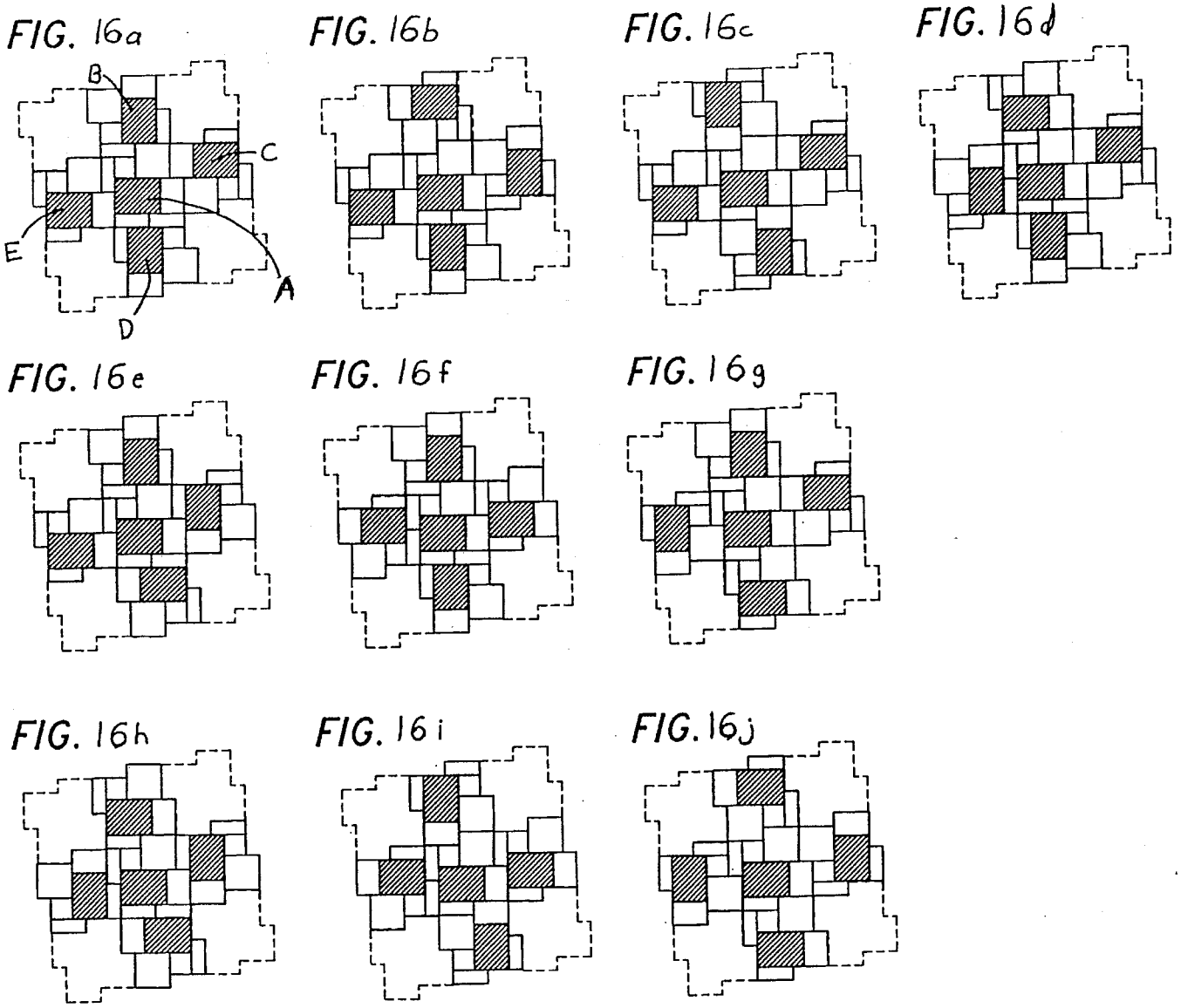
FIG. 16*a–j* are various non-repetitive mosaics made possible by rotating the tool of FIG. 10.

FIG. 16*a* shows the pattern 48 of five identical tools 30 or imprints formed by the tools. A middle tool A is oriented at the same angle as shown in FIG. 10 and thus will be described as being positioned at a zero angle. The tool B at the top has been rotated 90 degrees counter-clockwise from tool A. The tool C at the right has been rotated 180 degrees. The tool D at the bottom has been rotated 270 degrees. And finally, the tool E at the left is at zero degrees again.

FIGS. 16*b–j* illustrate 9 other possible variations of the unrotated tool A in the center surrounded by the same tool at different orientations. In fact, there are 256 possible combinations of this assembly. In a similar grouping, the prior art tool 20 can only form one pattern with a single tool, clearly illustrating the versatility of the present tool 30 when used singly.

Now refer back to FIG. 1, wherein three different tools shown in FIGS. 10–12 are used alternately and also rotated to generate a substantially random mosaic 32. The permutations for arrangements are essentially limitless. For example, the tools 30 may be rotated in a regular sequence with the first, second and third tools laid down at a zero degree rotation, then all rotated 90 degrees and laid down in sequence again, etc. Alternatively, the first, second and third tools may be laid down at a zero degree rotation, then all rotated 90 degrees and the order changed prior to laying the tools down again. Or, one tool may remain at zero degrees while the others are rotated.

It quickly becomes apparent that the improved forming tool 30 provides a marked increase in pattern variety and thus a relatively random mosaic such as in FIG. 1 is realized. A not insignificant advantage of the tool 30 is the reduced level of skill needed to form the patterns. Since the tools 30 fit together at any of four orientations it is a relatively mindless exercise to form a mosaic 42. One merely has to remember to either rotate one tool or change tools to avoid placing the same tool adjacent the last formed imprint.

While it is difficult to give a general description of the outline defined by the peripheral edges which allows tool to be rotated and fit together with other tools, there are several generalities which can be made. First of all, the outline 42 is rectilinear, that is, all peripheral edges are in one of two directions perpendicular to each other. Secondly, the outline includes four identically sized legs which are offset from a line parallel to the outward direction of the sides of the leg and which travels through the center point of the tool.

The present invention is described herein as one embodiment only and other variations are possible within the scope of the claims.

I claim:

1. A tool for forming imprints in a deformable material, comprising:

an upper support plate;

a rectilinear outline having four identically shaped outwardly extending legs;

a lower forming surface; and a center point, wherein said tool can be rotated 90° from a first position where it forms a first outline pattern to a second position about said center point where it forms a second outline pattern such that said second outline pattern is identical to said first outline pattern in both the first and second positions.

2. The tool of claim 1, wherein said forming surface comprises:

a plurality of rectilinear grout lines; and a plurality of textured areas between said grout lines.

3. The tool of claim 1, wherein said tool is substantially constructed from polyurethane.

4. A textured forming tool for concrete, comprising:

an upper support plate;

a rectilinear outline having four identically shaped outwardly extending legs;

a lower forming surface, comprising:

a plurality of rectilinear grout lines; and a plurality of textured areas between said grout lines, wherein said tool can be rotated 90° from a first position where a first outline pattern is formed on a flat surface to a second position where a second outline pattern is formed on said flat surface such that said first and second outline patterns are identical in both the first and second positions.

5. The tool of claim 4, comprising one or more handles attached to said support plate.

* * * * *